US010793997B2

(12) United States Patent
Kim et al.

(10) Patent No.: US 10,793,997 B2
(45) Date of Patent: Oct. 6, 2020

(54) STEAMER AND METHOD OF CONTROLLING THE SAME

(71) Applicant: LG ELECTRONICS INC., Seoul (KR)

(72) Inventors: Hyewon Kim, Seoul (KR); Jeaseok Seong, Seoul (KR); Taewoo Yoo, Seoul (KR); Kyungah Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 205 days.

(21) Appl. No.: 15/988,430

(22) Filed: May 24, 2018

(65) Prior Publication Data

US 2018/0340291 A1 Nov. 29, 2018

(30) Foreign Application Priority Data

May 24, 2017 (KR) ..... 10-2017-0064249

(51) Int. Cl.
*D06F 67/10* (2006.01)
*D06F 73/00* (2006.01)
*D06F 87/00* (2006.01)

(52) U.S. Cl.
CPC ..... *D06F 67/10* (2013.01); *D06F 73/00* (2013.01); *D06F 87/00* (2013.01); *D06F 2202/12* (2013.01); *D06F 2204/06* (2013.01); *D06F 2216/00* (2013.01)

(58) Field of Classification Search
CPC ..... D06F 67/10; D06F 73/00; D06F 87/00; D06F 2204/06; D06F 2216/00; D06F 2202/12
See application file for complete search history.

(56) References Cited

U.S. PATENT DOCUMENTS 5,420,961 A * 5/1995 Walker ..... A45D 44/00 392/403
5,609,047 A * 3/1997 Hellman, Jr. ..... D06F 73/00 239/538
5,721,418 A * 2/1998 Hazan ..... D06F 75/40 219/257
9,567,705 B2 2/2017 Chua et al.
(Continued)

FOREIGN PATENT DOCUMENTS

JP 2016-516522 6/2016
JP 2016-525419 8/2016
(Continued)

OTHER PUBLICATIONS

Korean Search Report dated Sep. 28, 2018 issued in Application No. PCT/KR2018/005896.

*Primary Examiner* — Joseph L. Perrin
(74) *Attorney, Agent, or Firm* — KED & Associates LLP

(57) ABSTRACT

A steamer may uniformly spray steam onto laundry even when a position of a user's arm changes. The steamer may include: a handle having a hinge formed at one end in a longitudinal direction thereof; a head that is rotatably connected to the hinge and sprays steam; a motor that rotates the head about the hinge; a sensor that senses an inclination in the longitudinal direction of the handle with respect to a horizontal line; and a controller that operates the motor, based on the inclination sensed by the sensor, to rotate the head to a position at which the head may spray steam horizontally.

20 Claims, 5 Drawing Sheets

(56) References Cited

U.S. PATENT DOCUMENTS

| | | | | |
|---|---|---|---|---|
| 2007/0209145 | A1* | 9/2007 | Tullett | A47L 5/30 15/339 |
| 2015/0128374 | A1* | 5/2015 | Carter | A47L 13/225 15/320 |
| 2016/0053430 | A1 | 2/2016 | Chua et al. | |
| 2016/0160434 | A1 | 6/2016 | Chua et al. | |
| 2016/0345795 | A1* | 12/2016 | Manning | A47L 11/34 |
| 2017/0184302 | A1 | 6/2017 | Chua et al. | |

FOREIGN PATENT DOCUMENTS

| | | |
|---|---|---|
| KR | 10-2011-0138470 | 12/2011 |
| KR | 10-2015-0007055 | 1/2015 |
| KR | 10-2017-0013929 | 2/2017 |

* cited by examiner

STEAMER AND METHOD OF CONTROLLING THE SAME

CROSS-REFERENCE TO RELATED APPLICATION

This application claims priority benefit of Korean Patent Application No. 10-2017-0064249, filed May 24, 2017 in the Korean Intellectual Property Office, the subject matter of which is incorporated herein by reference.

BACKGROUND

1. Field

The present disclosure relates to a steamer and a method of controlling the same. More particularly, the present disclosure relates to a steamer that may spray steam onto laundry for ironing, and a method of controlling the same.

2. Background

Washing machines that sequentially perform washing, rinsing, and spin-drying operations are an example of a laundry treatment apparatus.

The washing machine may be classified as a top-loading washing machine or a front-loading washing machine (also called a drum washing machine). The top-loading washing machine may perform washing of the laundry by using a rotating water stream generated in wash water. The front-loading washing machine may perform washing of the laundry by friction between laundry items that is generated when the laundry items are lifted and dropped by a lifter installed at an inner circumference of a drum.

After a main washing is performed by the washing machine, drying and ironing of the laundry may be performed.

Methods of ironing the laundry may include: a method of ironing by using an iron while the laundry is placed on an ironing board; and a method of ironing by using a steamer that sprays steam onto the laundry while the laundry is hung on a hanger.

However, in the example of ironing the laundry by using the steamer, a direction of spraying steam onto the laundry may change according to a position of a user's arm such that steam may not be sprayed uniformly onto the laundry, and/or a wrist strain may be caused when a user struggles to uniformly spray steam onto the laundry.

BRIEF DESCRIPTION OF THE DRAWINGS

Arrangements and embodiments may be described in detail with reference to the following drawings in which like reference numerals refer to like elements and wherein.

DETAILED DESCRIPTION

A steamer according to embodiments of the present disclosure may be described with reference to accompanying drawings.

Figure 1:
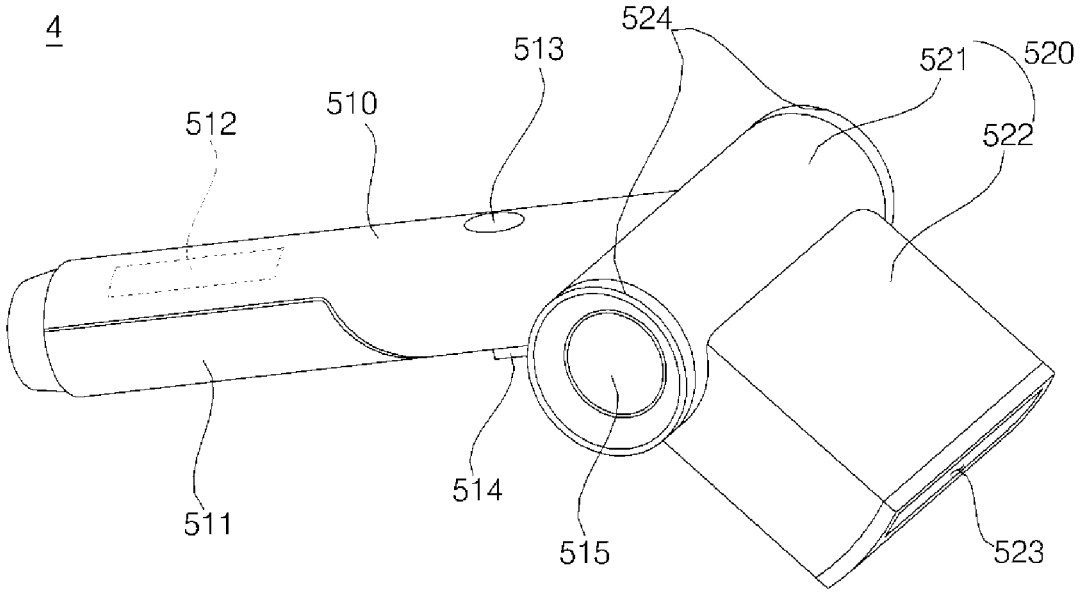
FIG. 1 is a perspective view of a steamer according to a first embodiment of the present disclosure.

FIG. 1 is a perspective view of a steamer according to a first embodiment of the present disclosure. Other embodiments and configurations may also be provided.

Referring to FIG. 1, a steamer 4 may include a handle 510 and a head 520.

The handle 510 is a portion of the steamer may be held by a user's hand, may have a cross-section of a circular shaped, and/or may be formed to be elongated. The cross-sectional shape of the handle 510 may not be limited to a circular shape. For example, the cross-sectional shape of the handle 510 may be formed in a square shape, and/or may be modified into various other shapes.

A battery 511 may be detachably connected (or coupled) to the handle 510. The battery 511 may be charged with power. The steamer 4 may operate by using the power of the battery 511.

A wireless charging part 512 may be provided in the handle 510. The wireless charging part 512 may also be called a wireless charging device or wireless charging component. The wireless charging part 512 may wirelessly charge the battery 511. The wireless charging part 512 may include a coil that electrically reacts with a charging coil of a wireless charging unit that is provided separately from the steamer 4, and the battery 511 may be charged by electrical reaction of the charging coil and the coil. The wireless charging unit may also be called a wireless charger or wireless charging device.

The handle 510 may include (or contain) a water container for storing water, and a spray nozzle for fine spray of water stored in the water container so that water particles may be sprayed. The head 520 may be provided with (or contain) a heater that applies heat to the water particles sprayed from the nozzle so that the water particles are phase-changed into steam.

A power switch 513 may be provided at (or on) the handle 510. The power switch 513 may be turned on or off by a user. The power switch being turned on or off may refer to the power switch or components of the power switch being considered to be in an on position (or on state) or an off position (or an off state). The power switch or components of the power switch may be on or may be off. In an example where the power switch 513 is turned on (or components are provided in an on position), the steamer 4 may operate. The power switch 513 may be disposed at an upper portion of the handle 510 so as to be turned on or off by a user's thumb.

A steam spray switch 514 may be disposed at (or on) the handle 510. The steam spray switch 514 may be turned on or off by a user. The steam spray switch being turned on or off may refer to the steam spray switch or components of the steam spray switch being considered to be in an on position (or on state) or an off position (or an off position). The steam spray switch or components of the steam spray which may be on or may be off. In an example where the steam spray switch 514 is turned on (or components may be provided in an on position), the head 520 may spray steam to outside of the steamer; and alternatively in an example where the steam spray switch 514 is turned off (or components may be provided in an off position), the head 520 may not spray steam to the outside of the steamer. The steam spray switch 514 may be disposed at a lower portion of the handle 510 to be turned on or off by a user's forefinger. When being pressed by a user's forefinger, the steam spray switch 514 may be turned on, and when the pressed switch is released, the steam spray switch 514 may be turned off.

The handle 510 may extend in a longitudinal direction, for example. At one end (in the longitudinal direction) of the handle 510, a hinge 515 may protrude in a direction orthogonal to the longitudinal direction. The hinge 515 may protrude from both sides at the one end (in the longitudinal direction) of the handle 510.

The head 520 may be rotatably connected to (or coupled to) the hinge 515 (of the handle 510). The head 520 may rotate about the hinge 515. For example, the head 520 may rotate with respect to the hinge 515. The head 520 may spray steam to outside of the steamer 4. A spray hole 523, which sprays the steam to the outside, may be provided at a front surface of the head 520.

A flow path direction of the spray hole 523 may be orthogonal to a protruding direction of the hinge 515. That is, the head 520 may spray steam from a rear side of the head 520 toward a front side of the head 520. The hinge 515 may protrude from both the left side and the right side at the one end (in a longitudinal direction) of the handle 510.

The head 520 may include: a cylindrical part 521 that is rotatably connected to the hinge 515; and a spray part 522 that extends forward from a circumferential surface of the cylindrical part 521 and has a front surface from which steam is sprayed. The spray part 522 may include a cavity and the front surface may be open. The open front surface of the spray part 522 may be provided with the spray hole 523 that sprays the steam. The spray part 522 may be formed in a hexahedral shape with an open front surface. The spray part 522 may be formed in a cylindrical shape with an open front surface. The shape of the spray part 522 is not limited to the hexahedral shape or the cylindrical shape, and may be modified into various other shapes.

A light emitting unit 524 (or light emitting component) may be disposed on both sides of the cylindrical part 521. The light emitting unit 524 may be provided in a ring shape corresponding to a circumference of the cylindrical part 521, and the light emitting unit 524 may be connected to the circumference on both sides of the cylindrical part 521. The light emitting unit 524 may generate and emit light. The light emitting unit 524 may include a light emitting diode (LED), for example. The light emitting unit 524 may emit light in a plurality of colors. For example, the light emitting unit 524 may emit light in blue and red, or emit light in blue, red, and green. In order to emit light in blue and red, the light emitting unit 524 may include a light emitting diode that generates blue light, and a light emitting diode that generates red light. In order to emit light in blue, red, and green, the light emitting unit 524 may include a light emitting diode that generates blue light, a light emitting diode that generates red light, and a light emitting diode that generates green light.

Figure 2:
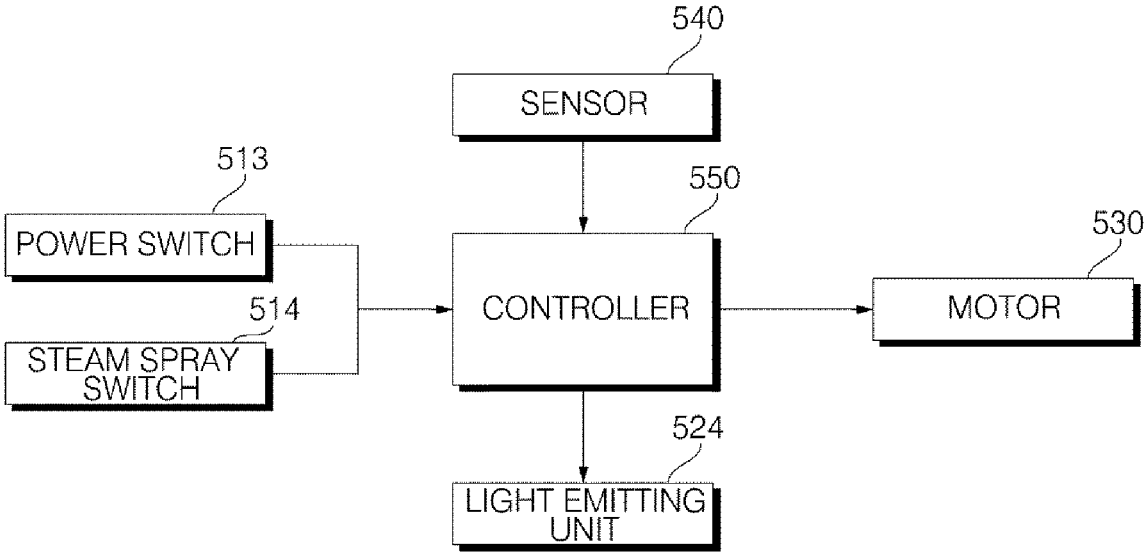
FIG. 2 is a block diagram illustrating a steamer according to a first embodiment.
Figure 3:
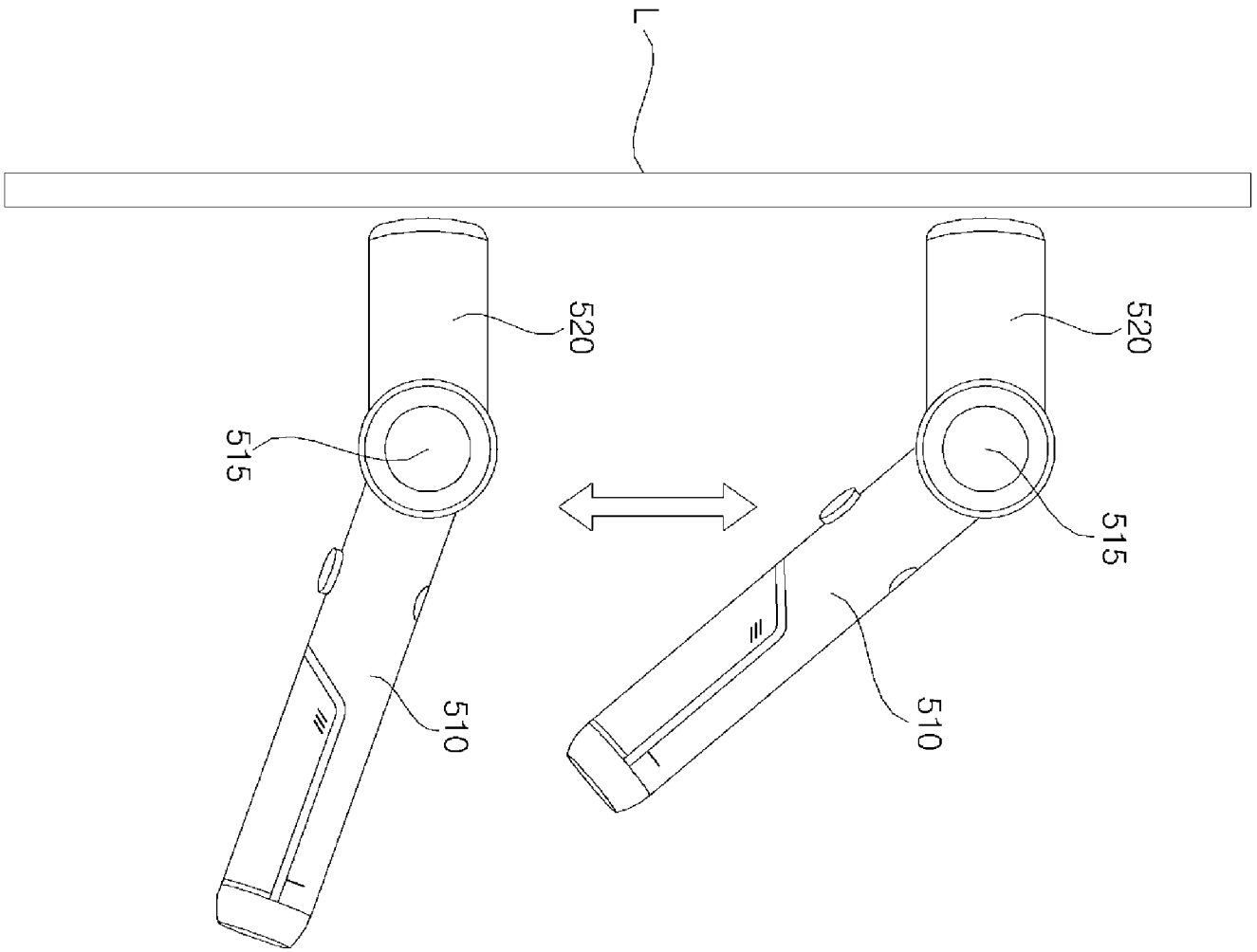
FIG. 3 is a side view illustrating an operation of a steamer according to a first embodiment.

FIG. 2 is a block diagram illustrating a steamer according to a first embodiment of the present disclosure. FIG. 3 is a side view illustrating an operation of a steamer according to a first embodiment of the present disclosure. Other embodiments and configurations may also be provided.

Referring to FIGS. 1 to 3, the steamer 4 may include a motor 530, a sensor 540, and a controller 550. Other components may also be provided.

As one example, the motor 530 may be disposed in the hinge 515 of the handle 510. A circular gear having gear teeth formed on a circumference thereof may be connected to a rotation axis of the motor 530. A ring gear, which is engaged with the circular gear, may be connected to an inner circumference of the cylindrical part 521 (of the head 520). Accordingly, the motor 530 may rotate the head 520 about the hinge 515. For example, the motor 530 may rotate the head 520 with respect to the hinge 515.

The sensor 540 (or sensor device) may be disposed in the handle 510 (or on the handle). The sensor 540 may sense an inclination (in a longitudinal direction) of the handle 510 with respect to a horizontal line. The inclination (or inclination information) sensed by the sensor 540 may be provided to the controller 550. The sensor 540 may be a gyro sensor, for example.

As one example, the controller 550 may be disposed in the handle 510. The controller 550 may control the light emitting unit 524 by using an ON/OFF signal (or signals) provided from the power switch 513. The controller 550 may control the light emitting unit 524 by using an ON/OFF signal (or signals) provided from the power switch 513 and an ON/OFF signal (or signals) provided from the steam spray switch 514. The controller 550 may control the motor 530 by using an ON/OFF signal (or signals) provided from the power switch 513, and the inclination of the handle 510 with respect to the horizontal line which is provided from the sensor 540. In at least one embodiment, the ON/OFF signal may include a first signal that corresponds to an ON signal. The ON signal may be provided when the corresponding switch and/or corresponding components are provided in an on position.

According to the inclination information from the sensor 540 while the steamer 4 operates, the controller 550 may control the motor 530 to rotate to a position where the head 520 may spray the steam horizontally (or at another specific orientation). Accordingly, as shown in FIG. 3, in an example of ironing laundry L hung on a hanger by using the steamer 4, even when the inclination of the handle 510 is changed, the head 520 may be maintained at a position at which the head 520 may continuously spray the steam horizontally. That is, when a user holds the handle 510 with a hand to spray the steam forward and downward of the laundry L, the inclination of the handle 510 may be changed, but the head 520 may be maintained at a position at which the head 520 may continuously spray the steam in a horizontal manner. Accordingly, the steamer 4 may uniformly spray the steam to the laundry L to iron the laundry L. In at least one example, a wrist strain may not occur when a user irons the laundry L.

The sensor 540 may sense the inclination when the power switch 513 is turned on (or components are provided in an on position). Once the power switch 513 is turned on, the controller 550 may operate the motor 530 to rotate the head 520 to a position at which the head 520 may spray the steam in a horizontal manner.

Once the power switch 513 is turned off (or components are provided in an off position), the controller 550 may operate the motor 530 to rotate the head 520 to an original position (or to a specific predetermined position). In an embodiment, the original position of the head 520 may be a position where a longitudinal direction of the head 520 coincides with a longitudinal direction of the handle 510. Accordingly, when the head 520 rotates to an original position, the handle 510 and the head 520 may be provided in a linear arrangement and/or shape.

Once the power switch 513 is turned on (or components are provided in an on position), the controller 550 may control the light emitting unit 524 to emit light in a first color. For example, the first color may be blue. That is, once the power switch 513 is turned on, the controller 550 may control the light emitting unit 524 to emit light in blue. Upon seeing that the light emitting unit 524 emits light in blue, a user may recognize that the power switch 513 is turned on (or components are provided in an on position).

When the power switch 513 and the steam spray switch 514 are turned on (or components are provided in an on position), the controller 550 may control the light emitting unit 524 to flicker in the first color. That is, with the power switch 513 turned on, when a user turns on the steam spray switch 514 to spray steam, the light emitting unit 524 may flicker in the first color. For example, while a user turns on the power switch 513 and the light emitting unit 524 emits light in blue, when the user turns on the steam spray switch 514 to spray steam, the light emitting unit 524 may flicker in blue. Upon seeing that the light emitting unit 524 flickers in blue, the user may recognize that the steam spray switch 514 is turned on and the steam may be sprayed.

When the power switch 513 and the steam spray switch 514 are turned on (or components are provided in an on position), the controller 550 may control the light emitting unit 524 to emit light in the second color. For example, the second color may be red. That is, when the power switch 513 and the steam spray switch 514 are turned on, the controller 550 may control the light emitting unit 524 to emit light in red. While a user turns on the power switch 513 and the light emitting unit 524 emits light in blue, when the user turns on the steam spray switch 514 to spray steam, the light emitting unit 524 may emit light in red. Upon seeing that the light emitting unit 524 emits light in red, the user may recognize that the steam spray switch 514 is turned on and the steam may be sprayed.

In an example where the power switch 513 is turned on (or components are provided in an on position), and a charge amount of the battery 511 is equal to or less than a first predetermined value, the controller 550 may determine that the battery 511 should be charged, and the controller 550 may control the light emitting unit 524 to flicker in the first color. While the power switch 513 is turned on and the light emitting unit 524 flickers in the first color, a user may determine that the battery 511 should be charged, and may charge the battery 511. That is, in an example in which the power switch 513 is turned on, and the light emitting unit 524 flickers light in blue, the user may determine that the battery 511 should be charged, and may charge the battery 511.

In an example where the power switch 513 is turned on and the charge amount of the battery 511 is equal to or less than the first predetermined value, the controller 550 may determine that the battery 511 should be charged, and the controller 550 may control the light emitting unit 524 to flicker in the second color. While the power switch 513 is turned on and the light emitting unit 524 emits light in the second color, a user may determine that the battery 511 should be charged, and may charge the battery 511. That is, in an example where the power switch 513 is turned on, and the light emitting unit 524 emits light in red, the user may determine that the battery 511 should be charged, and may charge the battery 511.

While the power switch 513 is turned off (or components are provided in an off position) and the wireless charging part 512 charges the battery 511, in an example where a charge amount of the battery 511 is equal to or less than a second predetermined value, which is greater than the first predetermined value, the controller 550 may determine that the battery 511 is not fully charged, and the controller 550 may control the light emitting unit 524 to flicker in the first color; and in an example where a charge amount of the battery 511 is greater than the second predetermined value, the controller 550 may determine that the battery 511 is fully charged, and the controller 550 may control the light emitting unit 524 to emit light in the first color. While the power switch 513 is turned off (or components are provided in an off position) and the battery 511 is charged, when the light emitting unit 524 flickers in the first color, the user may determine that the battery 511 is not fully charged, and may continue to charge the battery 511; and when the light emitting unit 524 emits light in the first color, the user may determine that the battery 511 is fully charged, and may stop charging of the battery 511. That is, while the power switch 513 is turned off and the battery 511 is charged, when the light emitting unit 524 flickers in blue, the user may determine that the battery 511 is not fully charged, and may continue to charge the battery 511; and when the light emitting unit 524 emits light in blue, the user may determine that the battery 511 is fully charged, and may stop charging of the battery 511.

While the power switch 513 is turned off (or components are provided in an off position) and the wireless charging part 512 charges the battery 511, in an example where a charge amount of the battery 511 is equal to or less than the second predetermined value, which is greater than the first predetermined value, the controller 550 may determine that the battery 511 is not fully charged, and the controller 550 may control the light emitting unit 524 to emit light in the second color; and in an example where a charge amount of the battery 511 is greater than the second predetermined value, the controller 550 may determine that the battery 511 is fully charged, and the controller 550 may control the light emitting unit 524 to emit light in third color. The third color may be green. While the power switch 513 is turned off and the battery 511 is charged, when the light emitting unit 524 emits light in the second color, the user may determine that the battery 511 is not fully charged, and may continue to charge the battery 511; and when the light emitting unit 524 emits light in the third color, the user may determine that the battery 511 is fully charged, and may stop charging of the battery 511. That is, while the power switch 513 is turned off and the battery 511 is charged, when the light emitting unit 524 emits light in red, the user may determine that the battery 511 is not fully charged, and may continue to charge the battery 511; and when the light emitting unit 524 emits light in green, the user may determine that the battery 511 is fully charged, and may stop charging of the battery 511.

Figure 4:
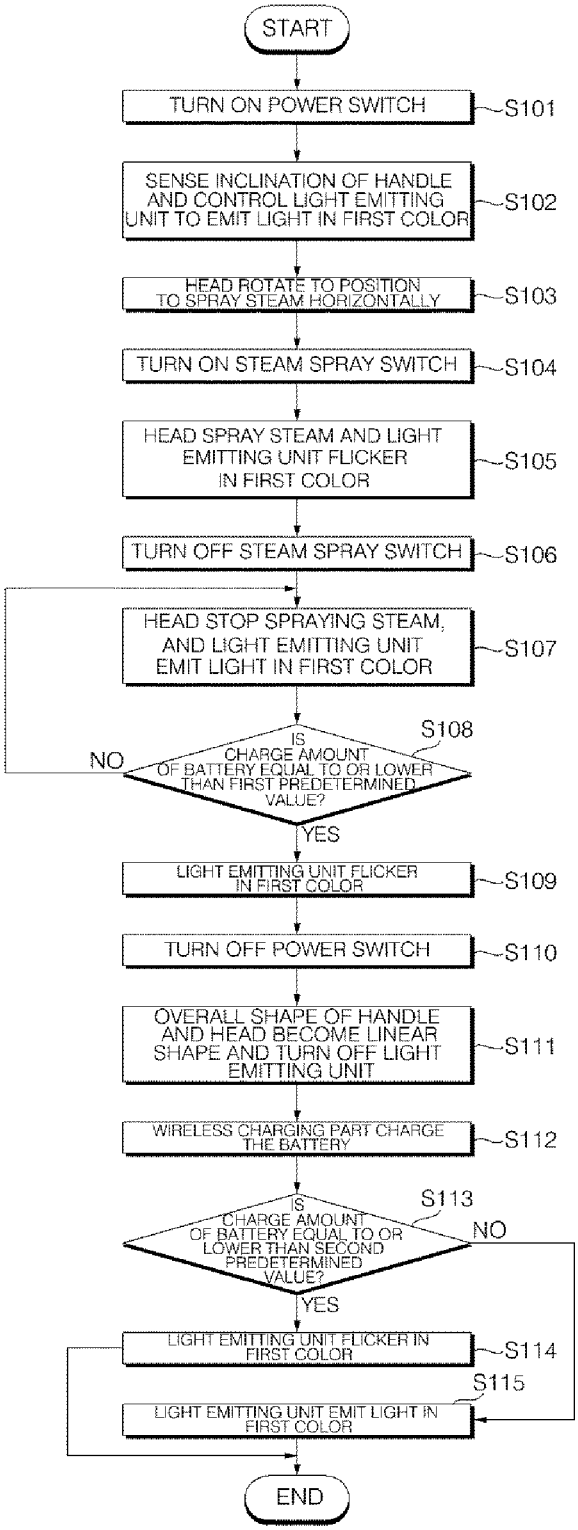
FIG. 4 is a flowchart illustrating a method of controlling a steamer according to a first embodiment.

FIG. 4 is a flowchart illustrating a method of controlling a steamer according to a first embodiment of the present disclosure. Other operations, orders of operations and embodiments may be provided. The method of controlling the steamer may be described in connection with the operation of the steamer.

Referring to FIG. 4, in S101 the power switch 513 may be turned on to use the steamer 4.

Once the power switch 513 is turned on, the sensor 540 may sense the inclination (in the longitudinal direction) of the handle 510 with respect to a horizontal line, and input the sensed inclination (or sensed inclination information) to the controller 550. The controller 550 may then control the light emitting unit 524 to emit light in blue (which is the first color) in S102.

According to the inclination information from the sensor 540, in S103 the controller 550 may control the motor 530 to rotate the head 520 to a position where the head 520 may spray steam in a horizontal manner. When a user moves the handle 510 up and/or down (while holding the handle with a hand) in order to iron the laundry L hung on a hanger, an angle of the user's arm may change, such that the inclination of the handle 510 may continuously change, and the head 520 may continuously rotate, by a driving force of the motor 530, to a position at which the head 520 may spray the steam in a horizontal manner.

The user may provide the spray hole 523 (of the head 520) on the laundry L, and may turn on the steam spray switch 514 in S104. The head 520 may then spray steam onto the laundry L through the spray hole 523, and the controller 550 may control the light emitting unit 524 to flicker in blue (which is the first color) in S105.

The user may turn off the steam spray switch 514 in S106. The head 520 may then stop spraying, and the controller 550 may control the light emitting unit 524 to emit light in blue (which is the first color) in S107.

When the power switch 513 is turned on, in S108 the controller 550 may determine whether a charge amount of the battery 511 is equal to or less than the first predetermined value. While the power switch 513 is turned on, in an example where the charge amount of the battery 511 is determined to be greater than the first predetermined value, the controller 550 may control the light emitting unit 524 to continue to emit light in blue (which is the first color) in S107. While the power switch 513 is turned on, in an example where the charge amount of the battery 511 is determined to be equal to or less than the first predetermined value, the controller 550 may control the light emitting unit 524 to flicker in blue (which is the first color) in S109.

Upon finishing ironing of the laundry L, in S110 the user may turn off the power switch 513. The head 520 may then rotate to an original position, the light emitting unit 524 may be turned off, and the light emitting unit may not emit light in S111. In at least one embodiment, the original position of the head 520 may be a position where a longitudinal direction of the head 520 coincides with a longitudinal direction of the handle 510, such that when the head 520 rotates to the original position, the overall shape of the handle 510 and the head 520 becomes a linear shape (or linear orientation).

While the power switch 513 is turned off, the user may charge the battery 511. That is, in S112 the wireless charging part 512 may charge the battery. The controller 550 may then determine in S113 whether a charge amount of the battery 511 is equal to or less than the second predetermined value, which is greater than the first predetermined value. In an example where the charge amount of the battery 511 is determined to be less than the second predetermined value, the controller 550 may determine that the battery 511 is not fully charged and control the light emitting unit 524 to flicker in blue (which is the first color) in S114. In an example where the charge amount of the battery 511 is determined to be greater than the second predetermined value, the controller 550 may determine that the battery 511 is fully charged, and control the light emitting unit 524 to emit light in blue (which is the first color) in S115.

Figure 5:
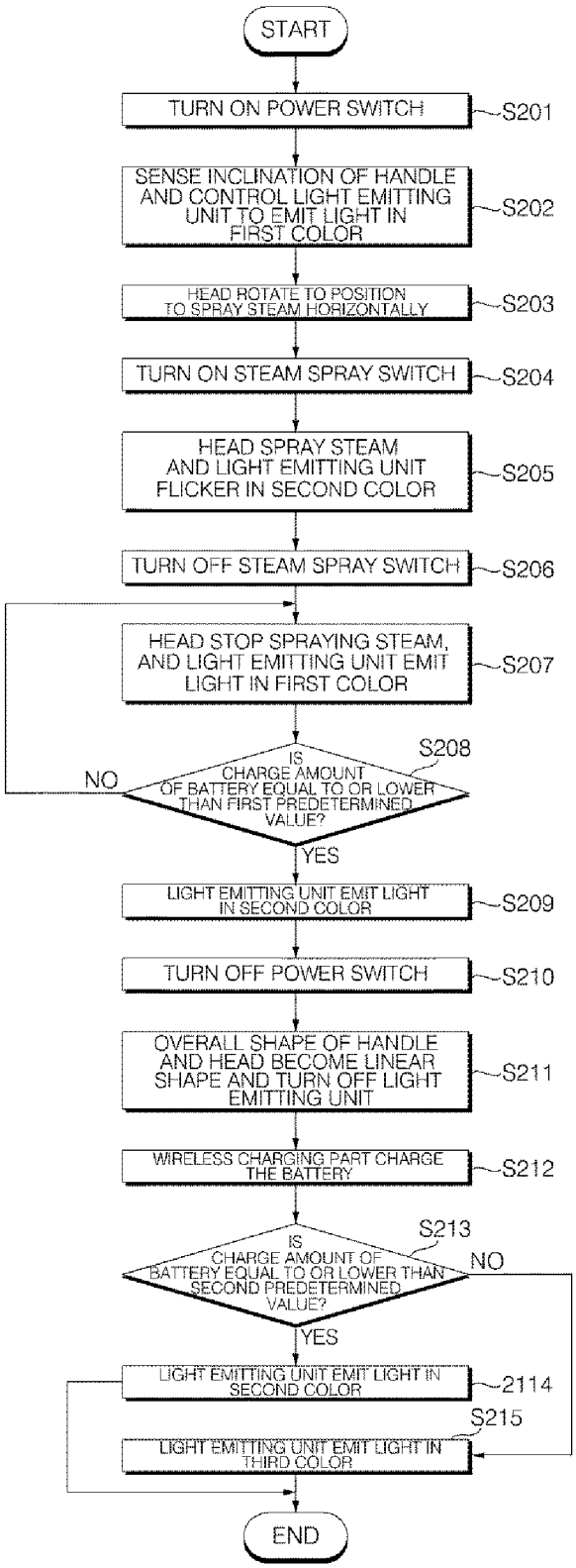
FIG. 5 is a flowchart illustrating a method of controlling a steamer according to a second embodiment of the present disclosure.

FIG. 5 is a flowchart illustrating a method of controlling a steamer according to a second embodiment of the present disclosure. Other operations, orders of operations and embodiments may also be provided.

Referring to FIG. 5, in S201 the power switch 513 may be turned on to use the steamer 4.

Once the power switch 513 is turned on, the sensor 540 may sense the inclination (in the longitudinal direction) of the handle 510 with respect to a horizontal line and input the sensed inclination (or sensed inclination information) to the controller 550. The controller 550 may then control the light emitting unit 524 to emit light in blue (which is the first color) in S202.

According to the inclination information from the sensor 540, in S203 the controller 550 may control the motor 530 to rotate the head 520 to a position at which the head 520 may spray steam in a horizontal manner. When a user moves the handle 510 up and/or down (while holding the handle with a hand) in order to iron the laundry L hung on a hanger, an angle of the user's arm may change, such that the inclination of the handle 510 may continuously change, and the head 520 may continuously rotate, by a driving force of the motor 530, to a position at which the head 520 may spray the steam in a horizontal manner.

The user may provide the spray hole 523 (of the head 520) on the laundry L, and turn on the steam spray switch 514 in S204. The head 520 may then spray steam onto the laundry L through the spray hole 523, and the controller 550 may control the light emitting unit 524 to emit light in red (which is the second color) in S205.

The user may turn off the steam spray switch 514 in S206. The head 520 may then stop spraying, and the controller 550 may control the light emitting unit 524 to emit light in blue (which is the first color) in S207.

When the power switch 513 is turned on, in S208 the controller 550 may determine whether a charge amount of the battery 511 is equal to or less than the first predetermined value. While the power switch 513 is turned on, in an example where the charge amount of the battery 511 is determined to be greater than the first predetermined value, the controller 550 may control the light emitting unit 524 to continue to emit light in blue (which is the first color) in S207. While the power switch 513 is turned on, in an example where the charge amount of the battery 511 is determined to be equal to or less than the first predetermined value, the controller 550 may control the light emitting unit 524 to emit light in red (which is the second color) in S209.

Upon finishing ironing of the laundry L, in S210 the user may turn off the power switch 513. The head 520 may then rotate to an original position, the light emitting unit 524 may be turned off, and the light emitting unit may not emit light in S211. In at least one embodiment, the original position of the head 520 may be a position where a longitudinal direction of the head 520 coincides with a longitudinal direction of the handle 510, such that when the head 520 rotates to the original position, the overall shape of the handle 510 and the head 520 becomes a linear shape (or linear orientation).

While the power switch 513 is turned off, the user may charge the battery 511. That is, in S212 the wireless charging part 512 may charge the battery. The controller 550 may then determine whether a charge amount of the battery 511 is equal to or less than the second predetermined value, which is greater than the first predetermined value in S213. In an example where the charge amount of the battery 511 is determined to be less than the second predetermined value, the controller 550 may determine that the battery 511 is not fully charged and control the light emitting unit 524 to emit light in red (which is the second color) in S214. In an example where the charge amount of the battery 511 is determined to be greater than the second predetermined value, the controller 550 may determine that the battery 511 is fully charged, and control the light emitting unit 524 to emit light in green (which is the third color) in S215.

As described above, in a steamer and a method of controlling the same according to the present disclosure, when the steamer 4 operates to iron the laundry L, a steam-spraying direction of the head 520 may be maintained to be horizontal, such that steam may be sprayed uniformly onto the laundry L, which may facilitate ironing of the laundry L.

Further, when a user turns on the power switch 513, the head 520 may rotate to a position at which the head 520 may uniformly spray steam.

Additionally, when the user turns off the power switch 513, the head 520 may automatically rotate to a position at which the head 520 may spray steam in a horizontal manner.

When the user turns off the power switch 513, the head 520 may automatically rotate to an original position, such that the steamer 40 may be easily stored in a storage space.

At least one of a light emitting pattern and a light emitting color of the light emitting unit 524 may be different to differentiate between when the steamer 4 sprays steam and when the steamer 4 does not spray steam. This may enable a user to easily recognize an operation state of the steamer 4 by seeing at least one of the light emitting pattern and the light emitting color.

Additionally, while the steamer 4 operates, at least one of the light emitting pattern and the light emitting color of the light emitting unit 524 may be different according to a charge amount of the battery 511. This may enable the user to easily recognize whether it is required to charge the battery 511 by seeing at least one of the light emitting pattern and the light emitting color.

While the battery 511 is charged, at least one of the light emitting pattern and the light emitting color of the light emitting unit 524 may be different according to a charge amount of the battery 511. This may enable the user to easily recognize whether the battery 511 is fully charged by seeing at least one of the light emitting pattern and the light emitting color.

It may be a first object to provide a steamer and a method of controlling the same, in which even when a position of a user's arm is changed, a spraying direction of steam is maintained horizontal, so that steam may be uniformly sprayed onto the laundry.

It may be a second object to provide a steamer and a method of controlling the same, in which when a power switch is turned on, a head rotates in a direction such that steam may be uniformly sprayed.

It may be a third object to provide a steamer and a method of controlling the same, in which the head returns to an original position, thereby enabling easy storage.

It may be a fourth object to provide a steamer and a method of controlling the same, in which at least one of a light emitting pattern and a light emitting color of a light emitting unit is different so as to differentiate between when steam is sprayed and when steam is not sprayed.

It may be a fifth object to provide a steamer and a method of controlling the same, in which at least one of a light emitting pattern and a light emitting color of a light emission part is different according to a charge amount of a battery while the steamer operates, so that a user may visually recognize the battery charge amount.

It may be a sixth object to provide a steamer and a method of controlling the same, in which at least one of a light emitting pattern and a light emitting color of a light emitting unit is different according to the charge amount of a battery while the battery is charged, so that a user may visually recognize the battery charge amount.

In order to achieve at least the first object, in accordance with an aspect of embodiments, there is provided a steamer including: a handle having a hinge formed at one end in a longitudinal direction thereof, the hinge protruding in a direction orthogonal to the longitudinal direction; a head which is rotatably connected to the hinge and sprays steam; a motor which rotates the head about the hinge; a sensor which senses an inclination in the longitudinal direction of the handle with respect to a horizontal line; and a controller which according to the inclination sensed by the sensor, operates the motor to rotate the head to a position at which the head sprays steam horizontally.

In order to achieve at least the second object, the steamer may include a power switch disposed at the handle, wherein the sensor may sense the inclination when the power switch is turned on, and while the power switch is turned on, the controller may operate the motor to rotate the head to a position at which the head sprays the steam horizontally, according to the inclination sensed by the sensor.

In order to achieve at least the third object, the controller may operate the motor to rotate the head to an original position when the power switch is turned off.

In order to achieve at least the fourth object, the steamer may include a power switch disposed at the handle, a steam spray switch disposed at the handle, and a light emitting unit which generates and emits light, wherein when the power switch is turned on, the controller may control the light emitting unit to emit light in first color, and when the power switch and the steam spray switch are turned on, the controller may control the light emitting unit to flicker in the first color or to emit light in second color.

In order to achieve at least the fifth object, the steamer may include a power switch disposed at the handle, a battery, and a light emitting unit which generates and emits light, wherein when the power switch is turned on, the controller may control the light emitting unit to emit light in first color, and when the power switch is turned on and a charge amount of the battery is equal to or lower than a first predetermined value, the controller may control the light emitting unit to emit light in second color.

In order to achieve at least the sixth object, the steamer may include a wireless charging part to charge the battery, wherein when the power switch is turned off and the wireless charging part charges the battery, in response to the charge amount of the battery being equal to or less than a second predetermined value which is greater than the first predetermined value, the controller may control the light emitting unit to flicker in the first light or to emit light in the second color, and in response to the charge amount of the battery being greater than the second predetermined value, the controller may control the light emitting unit to emit light in third color.

With respect to at least the first object, when the steamer operates to iron laundry, a steam-spraying direction of the head is maintained to be horizontal, such that steam may be sprayed uniformly onto the laundry, which may facilitate ironing of the laundry.

With respect to at least the second object, when a user turns on the power switch, the head may rotate to a position at which the head may uniformly spray steam.

With respect to at least the third object, when the user turns off the power switch, the head may automatically rotate to an original position, such that the steamer may be easily stored in a storage space.

With respect to at least the fourth object, at least one of a light emitting pattern and a light emitting color of the light emitting unit is different to differentiate between when the steamer sprays steam and when the steamer does not spray steam, thereby enabling a user to easily recognize an operation state of the steamer seeing at least one of the light emitting pattern and the light emitting color.

With respect to at least the fifth object, while the steamer operates, at least one of the light emitting pattern and the light emitting color of the light emitting unit is different according to a charge amount of the battery, thereby enabling the user to easily recognize whether it is required to charge the battery by seeing at least one of the light emitting pattern and the light emitting color.

With respect to at least the sixth object, while the battery is charged, at least one of the light emitting pattern and the light emitting color of the light emitting unit is different according to a charge amount of the battery, thereby enabling the user to easily recognize whether the battery is fully charged by seeing at least one of the light emitting pattern and the light emitting color.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A steamer comprising:

a handle that extends in a longitudinal direction from a first end to a second end, the handle having a hinge at the second end of the handle, the hinge protruding in a direction orthogonal to the longitudinal direction;

a head that is rotatably coupled to the hinge at a first end of the head, and the head to spray steam from a second end of the head;

a motor that rotates the head relative to the hinge;

a sensor that senses an inclination of the handle with respect to a horizontal line; and a controller configured to operate the motor, based on the sensed inclination, and to rotate the head such that the head is to spray steam in a direction corresponding to the horizontal line, wherein the head includes:

a heater that applies heat to water particles so that the water particles are phase-changed into steam, and a spray hole that sprays the steam to the outside.

2. The steamer of claim 1, wherein the controller is configured to control the motor to rotate the head such that the head is to spray steam in a horizontal manner.

3. The steamer of claim 2, further comprising a power switch disposed at the handle, wherein the sensor senses the inclination when the power switch is on, and while the power switch is on, the controller is configured to control the motor to rotate the head such that the head sprays the steam in a horizontal manner, based on the sensed inclination.

4. The steamer of claim 3, wherein when the power switch is turned off, the controller is configured to control the motor to rotate the head to a specific position relative to the handle.

5. The steamer of claim 1, further comprising:
a power switch disposed at the handle,
a steam spray switch disposed at the handle, and
a light emitting unit that generates and emits light,
wherein when the power switch is on, the controller is configured to control the light emitting unit to emit light in a first color, and
when the power switch is on and the steam spray switch is on, the controller is configured to control the light emitting unit to flicker the light in the first color.

6. The steamer of claim 1, further comprising:
a power switch disposed at the handle,
a steam spray switch disposed at the handle, and
a light emitting unit that generates and emits light,
wherein when the power switch is on, the controller is configured to control the light emitting unit to emit light in a first color, and
when the power switch is on and the steam spray switch is on, the controller is configured to control the light emitting unit to emit light in a second color.

7. The steamer of claim 1, further comprising:
a power switch disposed at the handle,
a battery, and
a light emitting unit that generates and emits light,
wherein when the power switch is on, the controller is configured to control the light emitting unit to emit light in a first color, and
when the power switch is on and a charge amount of the battery is equal to or less than a first predetermined value, the controller is configured to control the light emitting unit to flicker the light in the first color.

8. The steamer of claim 7, further comprising a wireless charging device to charge the battery,
wherein when the power switch is off and the wireless charging device is to charge the battery, the controller is configured to:
control the light emitting unit to flicker in the first color, in response to a determination that the charge amount of the battery is equal to or less than a second predetermined value, which is greater than the first predetermined value, and
control the light emitting unit to emit light in the first color, in response to a determination that the charge amount of the battery is greater than the second predetermined value.

9. The steamer of claim 1, further comprising:
a power switch disposed at the handle,
a battery, and
a light emitting unit that generates and emits light,
wherein when the power switch is on, the controller is configured to control the light emitting unit to emit light in a first color, and
when the power switch is on and a charge amount of the battery is equal to or less than a first predetermined value, the controller is configured to control the light emitting unit to emit light in a second color.

10. The steamer of claim 9, further comprising a wireless charging device to charge the battery,
wherein when the power switch is off and the wireless charging device is to charge the battery, the controller is configured to:
control the light emitting unit to emit light in the second color, in response to a determination that the charge amount of the battery is equal to or less than a second predetermined value, which is greater than the first predetermined value, and
control the light emitting unit to emit light in a third color, in response to a determination that the charge amount of the battery is greater than the second predetermined value.

11. A method of controlling a steamer that comprises a handle, a head, a motor, and a sensor, wherein the handle extends in a longitudinal direction, the handle having a hinge formed at one end in the longitudinal direction of the handle, the hinge protruding in a direction orthogonal to the longitudinal direction, wherein the head is rotatably coupled to the hinge, and the head to spray steam, wherein the motor rotates the head with respect to the hinge, and wherein the sensor senses an inclination in the longitudinal direction of the handle with respect to a horizontal line,
wherein the method of controlling the steamer comprises:
sensing, by the sensor, the inclination of the handle relative to the horizontal line; and
controlling the motor to rotate the head such that the head sprays steam in a direction corresponding to the horizontal line, based on the sensed inclination.

12. The method of claim 11, wherein the controlling of the motor includes rotating the head such that the head is to spray steam in a horizontal manner.

13. The method of claim 12, wherein the steamer comprises a power switch disposed at the handle,
wherein when the power switch is on, sensing the inclination includes sensing the inclination by the sensor; and
when the power switch is on, controlling the motor includes controlling the motor to rotate the head such that the head sprays the steam in the horizontal manner, based on the sensed inclination.

14. The method of claim 13, wherein when the power switch is turned off, the controlling of the motor includes controlling the motor to rotate the head to an original position.

15. The method of claim 11, wherein the steamer comprises a power switch disposed at the handle, a steam spray switch disposed at the handle, and a light emitting unit that generates and emits light,
wherein the method further comprises:
controlling the light emitting unit to emit light in a first color when the power switch is on, and
controlling the light emitting unit to flicker the light in the first color when the power switch is on and the steam spray switch is on.

16. The method of claim 11, wherein the steamer comprises a power switch disposed at the handle, a steam spray switch disposed at the handle, and a light emitting unit that generates and emits light,
wherein the method further comprises:
controlling the light emitting unit to emit light in a first color when the power switch is on, and
controlling the light emitting unit to emit light in a second color when the power switch is on and the steam spray switch is on.

17. The method of claim 11, wherein the steamer comprises a power switch disposed at the handle, a battery, and a light emitting unit that generates and emits light,
wherein the method further comprises:
controlling the light emitting unit to emit light in a first color when the power switch is on, and
controlling the light emitting unit to flicker the light in the first color when the power switch is on and a charge amount of the battery is equal to or less than a first predetermined value.

18. The method of claim 17, wherein the steamer comprises a wireless charging device to charge the battery, wherein the method further comprises:

when the power switch is off and the wireless charging device is to charge the battery, and the charge amount of the battery is determined to be equal to or less than a second predetermined value, which is greater than the first predetermined value, controlling the light emitting unit to flicker in the first color, and when the power switch is off and the wireless charging device is to charge the battery, and the charge amount of the battery is determined to be greater than the second predetermined value, controlling the light emitting unit to emit light in the first color.

19. The method of claim 11, wherein the steamer comprises a power switch disposed at the handle, a battery, and a light emitting unit that generates and emits light, wherein the method further comprises:

controlling the light emitting unit to emit light in a first color when the power switch is on, and controlling the light emitting unit to emit light in a second color when the power switch is on and a charge amount of the battery is equal to or less than a first predetermined value.

20. The method of claim 19, wherein the steamer comprises a wireless charging device to charge the battery, wherein the method further comprises:

when the power switch is off and the wireless charging device is to charge the battery, and the charge amount of the battery is determined to be equal to or less than a second predetermined value, which is greater than the first predetermined value, controlling the light emitting unit to emit light in the second color, and when the power switch is off and the wireless charging device is to charge the battery, and the charge amount of the battery is determined to be greater than the second predetermined value, controlling the light emitting unit to emit light in a third color.

* * * * *